United States Patent [19]

Okamura et al.

[11] 4,408,531

[45] Oct. 11, 1983

[54] BLANKET TENSIONING SYSTEM IN PRESS

[75] Inventors: Yuichi Okamura, Tokyo; Akitoshi Komatsu, Yokohama, both of Japan

[73] Assignee: Tokyo Kikai Seisakusho Ltd., Tokyo, Japan

[21] Appl. No.: 336,510

[22] Filed: Jan. 4, 1982

[30] Foreign Application Priority Data

Oct. 16, 1981 [JP] Japan ..... 56-153983[U]

[51] Int. Cl.[3] ..... B41F 27/12

[52] U.S. Cl. ..... 101/415.1

[58] Field of Search ..... 101/415.1

[56] References Cited

U.S. PATENT DOCUMENTS

| | | | |
|---|---|---|---|
| 3,885,486 | 5/1975 | Kirkpatrick et al. | 101/415.1 X |
| 3,893,394 | 7/1975 | Fusco et al. | 101/415.1 |
| 4,261,262 | 4/1981 | Jeschke | 101/415.1 |
| 4,337,700 | 7/1982 | Etchell et al. | 101/415.1 |

*Primary Examiner*—Edgar S. Burr
*Assistant Examiner*—David A. Wiecking
*Attorney, Agent, or Firm*—Trexler, Bushnell & Wolters, Ltd.

[57] ABSTRACT

A groove having parallel walls is formed in the longitudinal direction of a blanket cylinder.

A pair of retainers are attached to and along both ends of a blanket. The opposing end surfaces of the pair of retainers have alternating convexities and concavities arranged to permit the opposing surfaces to slide up and down relatively to each other. The total width of the pair of retainers with the convexities and concavities mating with each other coincides with the width of the groove. The pair of retainers are guided by the walls of the groove such that each retainer can be moved up and down along the associated wall independently of each other as a plurality of tensioning bolts are tightened or loosened.

Whereby, the tension can be applied only to the portion of the blanket which tends to be slack, in response to the change of the slacking portion due to the change of direction of rotation of the blanket cylinder, while applying no tension to the portion of the blanket irrespective of the direction of rotation to the portion of the blanket which is in close and good contact with the blanket cylinder to preserve the good contacting condition.

6 Claims, 6 Drawing Figures

BLANKET TENSIONING SYSTEM IN PRESS

BACKGROUND OF THE INVENTION

The present invention relates to a blanket tensioning system for tensioning a blanket such as of woolen cloth, rubber sheet or the like around a blanket cylinder of an offset press.

The blanket stretched on the peripheral surface of the blanket cylinder is gradually elongated and becomes loose during the use of the press due to contact between an impression cylinder and a plate cylinder. It is, therefore, necessary to tension the blanket not only at the initial stage of operation but also during the long use of the press.

The conventional blanket tensioning systems can be broadly sorted into two types: namely one end adjustable type in which the tension is applied only to one end of the blanket while the other end is fixed, and two-end adjustable types which are also sorted into two types; namely a single spindle type in which both ends of the blanket are caught in a groove of a common spindle so that both ends are equally tensioned as the spindle is rotated, and two spindle type in which each end of the blanket is caught by each spindle independently of each other.

However, in the case of these spindle types, while both ends of the spindle are rotatably supported by brackets, the middle portion of the spindle bends under tensioning of the blanket, so that the middle portion of the blanket is more loose than the both end portions of the blanket.

On the other hand, since the groove in the peripheral surface of the blanket cylinder brings about an irregular printing whenever the groove rotatively contacts with the peripheral surface of the other cylinders, width of the groove should be minimized as much as possible in order to reduce the impacts occurring with the contacts.

In general, the loosening or slack of the blanket tends to appear in the trailing end portion rather than in the leading end portion, because the blanket cylinder in the press is usually rotated only in one direction. The portion of the blanket other than the trailing end portion is suitably tensioned due to the contact between the impression cylinder and the plate cylinder, and is held in good close contact with the peripheral surface of the blanket cylinder. It is, therefore, desirable that the tensioning is effected only in the portion near the trailing end of the blanket where the slack appears, without applying any tension to the portion which is held in good tension and close contact with the peripheral surface of the blanket cylinder. From this point of view, the one-end adjusting type system is preferred to the two-end adjusting type system mentioned before.

In recent years, however, there is a new requirement in this field of technic, in addition to the above-described demand. Namely, the use of such a press is becoming popular as having a pair of offset press units one of which is adapted to be rotated not only in the forward direction but also in the backward direction as desired, to permit a diversification of the printing specification such as capability of both of mono-color printing in both sides and two-color printing on a single side. In such a type of press, the leading end portion of the blanket which has been tensioned is changed into the trailing end portion in which the slack tends to appear, while the trailing end portion of the blanket which has been slackened is changed into the leading end portion of the blanket which is suitably tension, as the direction of rotation is changed. This gives a rise to a demand for a blanket tensioning system capable of dealing with such a change of state of tensioning of the blanket. Neither the one-end type tensioning system nor the two-end type tensioning system can cope with this demand.

SUMMARY OF THE INVENTION

A first object of the invention is to provide a blanket tensioning system capable of tensioning one end of the blanket independently of the other end.

A second object of the invention is to provide a blanket tensioning system capable of tensioning several partial portions on each end of the blanket independently of the other portions of the same end of the blanket.

A third object of the present invention is to provide a blanket tensioning system capable of minimizing the width of the groove in the peripheral surface of the blanket cylinder as much as possible in order to reduce the impacts occurring with the rotative contacts with the peripheral surface of the other cylinders.

To this end, according to the present invention, there is provided the following constructions in a groove formed in the peripheral surface of a blanket cylinder and extending in the longitudinal direction of the blanket cylinder, the groove having parallel walls.

(1) A pair of retainers is attached to and along both ends of the blanket and they are movable up and down along the associated walls of the groove independently of each other to effect tensioning of the leading end portion or trailing end portion of the blanket independently of the other end.

(2) A plurality of tightening bolts are arranged to and along the said retainers in order to be partially adjustable in several positions on each end of the blanket independently of the other portions of the same end of the blanket.

(3 ) The pair of said retainers having opposing ends provided with alternately convexities and concavities mating with each other in such manner as to permit said retainers to be sliding up and down relatively to each other and they have such a width that the total width of said retainers with said convexities and concavities mating each other coincides with the width of said groove.

These and other objects, as well as advantageous features of the invention will become clear from the following description of the prepared embodiments taken in conjunction with the accompanying drawings.

DESCRIPTION OF THE PREFERRED EMBODIMENTS

Figure 1:
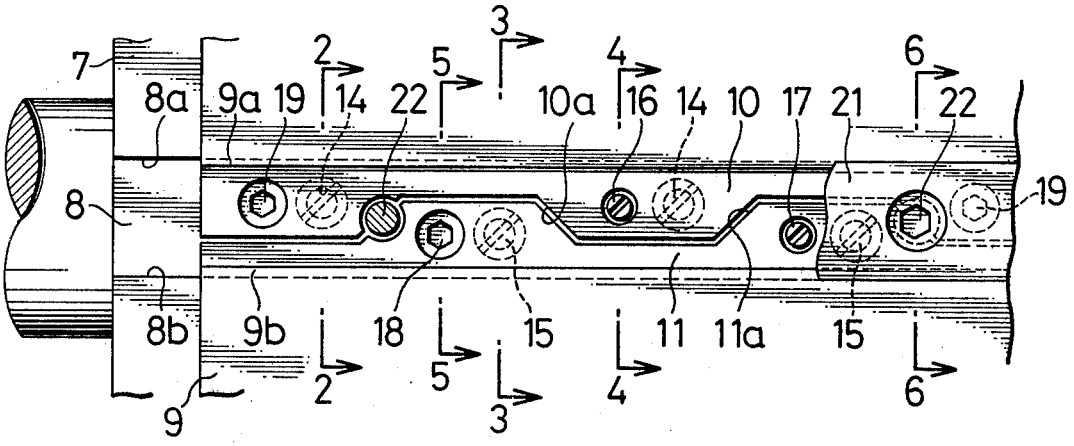
FIG. 1 is a partly cut-away plan view of an essential part of the peripheral surface of a blanket cylinder.
Figure 2:
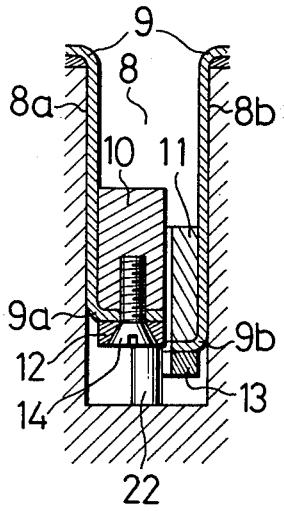
FIG. 2 is a vertical sectional view of the blanket cylinder as viewed from the left side, taken along the line 2—2 of FIG. 1.
Figure 3:
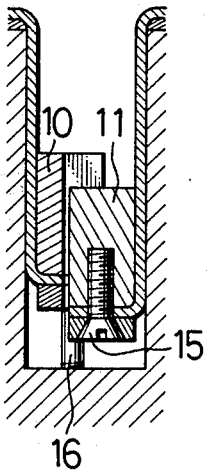
FIG. 3 is a vertical sectional view of the blanket cylinder as viewed from the left side, taken along the line 3—3 of FIG. 1.

A blanket cylinder 7 is provided in its outer peripheral surface with a longitudinal groove 8 having parallel opposing walls 8*a* and 8*b*. The groove 7 is adapted to receive both ends 9*a*,9*b* of the blanket 9.

To both ends 9*a*,9*b* of the blanket 9, attached beforehand are a pair of retainers 10,11 along the edges of the ends by means of, for example, pressing plate 12,13 and screws 14,15.

The pair of retainers 10,11 have opposing surfaces 10*a*, 11*a* which are provided with complementary alternating convexities and concavities. The retainers have such a width or widths that the total width of the retainers with their convexities and concavities mating together coincide with the width of the groove 8.

Figure 4:
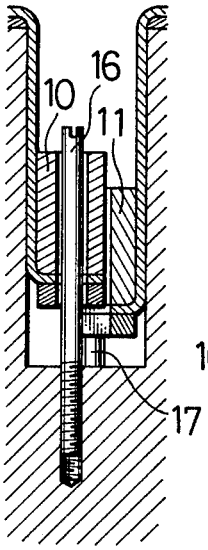
FIG. 4 is a vertical sectional view of the blanket cylinder as viewed from the left side, taken along the line 4—4 of FIG. 1.

Referring to FIGS. 1 and 4, reference numerals 16 and 17 designate a pair of guide pins for the retainers. These guide pins 16,17 are protruded upwardly from the bottom of the groove 8 so as to be received by corresponding holes formed in the retainers, so that the retainers are movable up and down along the associated walls 8*a*,8*b* while being guided by the pins 16,17 independently of each other.

Figure 5:
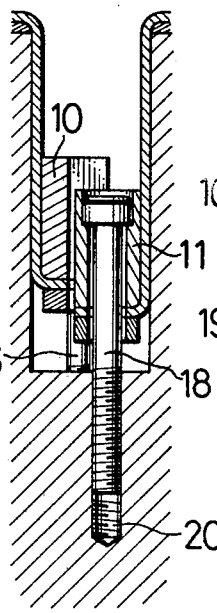
FIG. 5 is a vertical sectional view of the blanket cylinder as viewed from the left side, taken along the line 5—5 of FIG. 1.

Referring now to FIGS. 1 and 5, reference numerals 18 and 19 denote tightening bolts which are loosely received by the vertical holes formed in the retainer 10 or 11. These bolts are screwed into threaded holes 20 formed in the bottom of the groove so that the retainer is pressed and displaced deeper into the groove as the bolts 18,19 are tightened.

Figure 6:
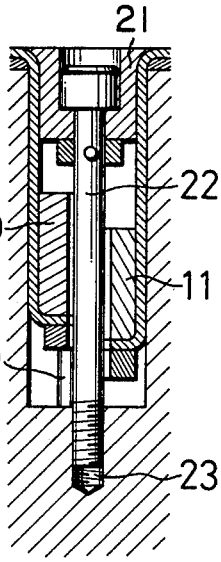
FIG. 6 is a vertical sectional view of the blanket cylinder as viewed from the left side, taken along the line 6—6 of FIG. 1.

Referring now to FIGS. 1 and 6, a reference numeral 21 designates a bridge adapted to fit in the groove 8. The bridge 21 has an outer surface of the same curvature as the peripheral surface of the blanket cylinder 7, so that the discontinuity of the surface of the blanket cylinder 7 is eliminated by the bridge 21 to provide a smooth contact without any impact between the blanket cylinder and the impression and plate cylinders. The bridge 21 is attached to the blanket cylinder by screwing the bolts 22 extending through the retainers into threaded holes 23 formed in the bottom of the groove.

The blanket 9 is attached to the blanket cylinder 7 in the following procedure. After detaching the bridge 21 from the groove 8 by loosening and removing the bolts 22, the tightening bolts 18,19 are removed to permit the withdrawal of the pair of retainers 10,11 from the groove along the guide pins 16,17. Then, the retainers 10 and 11 are secured to one and the other ends 9*a*,9*b* of the blanket 9, respectively, by means of the pressing plates 12,13 and the screws 14,15.

The outer extremitiers of the blanket to which the retainers are attached are cut in conformity with the contours of convexities and concavities of the opposing end surfaces 10*a*,11*a* of the retainers 10,11. As a result of this cutting, the opposing end surfaces of the retainers are allowed to move without being interfered by each other.

The retainers 10,11 are combined with each other in such a manner that the convexities and concavities of the opposing end surfaces fit each other as shown in FIG. 1. In this state, the total width of the retainers 10,11 is equal to the width of the groove 8, so that the retainers 10,11 can sink in the groove 8 while being guided by the guide pins 16,17.

In this state, as the tightening screws 18 or 19 are driven into the threaded holes, the associated retainer presses the corresponding end of the blanket into the groove thereby to suitably tension the blanket 9 on the peripheral surface of the blanket cylinder 7.

As stated before, the blanket 9 is elongated during the operation of the press due to the contact with the impression cylinder and the plate cylinder, and the resultant slack of the blanket appears generally in the trailing end portion of the blanket 9. In such a case, the slack can be eliminated by driving the bolts 18, for example, of the retainer attached to the trailing end of the blanket.

As the blanket cylinder is reversed, the leading end of the blanket becomes the trailing end in which the slack appears. Therefore, to eliminate this slack, the other bolts 19 are driven to press the retainer which is now at the trailing end of the blanket.

As has been described, in the blanket tensioning system of the present invention, since the retainers 10 and 11 are attached to and along both ends 9*a*, 9*b* of the blanket 9, they are movable up and down along the associated walls 8*a* and 8*b* of the groove 8 independently of each other to effect tensioning of the leading end portion or trailing end portion of the blanket 9 independently of the other end.

Further, a plurality of the tightening bolts 18 and 19 are engaged with said retainers 10 and 11 so that several positions on each end of the blanket are partially adjustable independently of the other portions of the same end of the blanket 9.

Furthermore, the retainers 10 and 11 have opposing ends 10*a* and 10*b* provided with alternating convexities and concavities mating with each other in such a manner as to permit said retainers to be sliding up and down relatively to each other, and they have such a width that the total width of said retainers with said convexities and concavities mating each other is approximately equal to the width of said groove, so that width of the groove 8 can be narrow as much as possible to effect smooth printing without irregularities.

What is claimed is:

1. A blanket tensioning system comprising: a groove formed in the outer peripheral surface of a blanket cylinder to extend in the longitudinal direction of said blanket cylinder, said groove having parallel opposing walls; a pair of retainers, each of said retainers being attached to an opposite end of a blanket so as to maintain a portion of said blanket adjacent each said end within said groove, and said retainers having opposing surfaces provided with alternating convexities and concavities mating with each other whereby said retainers are free to slide up and down relative to each other, said retainers each having a width such that the total width of the mated retainers, with the attached blanket ends is substantially equal to the width of said groove; and a plurality of tightening bolts engaged with each of said retainers and being adapted to selectively displace either of said retainers toward the bottom of said groove independent of the other of said retainers.

2. A blanket tensioning system as claimed in claim 1, wherein a bridge having a surface of the same curvature as said blanket cylinder is fitted in said groove.

3. A blanket tensioning system comprising: a groove formed in the outer peripheral surface of a blanket cylinder to extend in the longitudinal direction of said blanket cylinder, said groove having parallel opposing walls; a pair of retainers, each of said retainers being attached to an opposite end of a blanket so as to maintain a portion of said blanket adjacent each said end within said groove, the retainers with the blanket ends attached thereto being disposed in the groove, said retainers have opposing surfaces provided with a alternating convexities and concavities mating with each other such that the concavities of one retainer mate with the convexities of the other retainer so as to minimize the overall width of the retainers when assembled and permit the retainers to move relative to each other within the groove, and the retainers each having a width, such that the total width of the retainers with the atached blanket ends is substantially equal to the width of said groove except for sufficient clearance to permit said relative movement of the retainers; and adjusting means operatively coupled with each said retainer, such that the retainers may be moved independent of each other, whereby each of said retainers is movably up and down along the associated wall of said groove independent of the other of said retainers to effect tensioning of the respective ends of the blanket independently of the other blanket end.

4. A blanket tensioning system according to claim 3 further including a bridge disposed in said groove and having an outer surface of substantially the same curvature as the blanket cylinder.

5. A blanket tensioning system according to claim 3 wherein said adjusting means comprise a plurality of tightening bolts engaged with each of said retainers.

6. A blanket tensioning system comprising: a groove formed in the peripheral surface of a blanket cylinder to extend in the longitudinal direction of said blanket cylinder, said groove having parallel opposing walls; a pair of retainers, each of said retainers being attached to an opposite end of a blanket so as to maintain a portion of said blanket adjacent each said end within said groove, and said retainers having opposing surfaces provided with alternating convexities and concavities mating with each other, each said retainer having a width such that the total width of said retainers with the attached blanket ends, and with said convexities and concavities mating each other is approximately equal to the width of said groove; and a plurality of tightening bolts engaged with each of said retainers and being adapted to selectively displace either of said retainers toward the bottom of said groove to effect independent movement of said retainers with respect to the other of said retainers within said groove.

* * * * *